US006971883B1

(12) United States Patent
Ridge

(10) Patent No.: US 6,971,883 B1
(45) Date of Patent: Dec. 6, 2005

(54) TRAILER ELECTRICAL CONNECTOR ENCLOSURE

(76) Inventor: Michael Ridge, 130 S. Lakeview Ave., Anaheim, CA (US) 92807

( * ) Notice: Subject to any disclaimer, the term of this patent is extended or adjusted under 35 U.S.C. 154(b) by 0 days.

(21) Appl. No.: 10/942,673

(22) Filed: Sep. 15, 2004

(51) Int. Cl.[7] ..... H01R 33/00
(52) U.S. Cl. ..... 439/35; 439/687; 439/142; 439/465
(58) Field of Search ..... 439/35, 465, 142, 439/687, 696

(56) References Cited

U.S. PATENT DOCUMENTS

| | | | | | |
|---|---|---|---|---|---|
| 4,283,072 | A | | 8/1981 | Deloach, Jr. | |
| 4,420,204 | A | * | 12/1983 | Leong | 439/599 |
| 4,842,532 | A | * | 6/1989 | Krause | 439/174 |
| 4,940,427 | A | | 7/1990 | Pearson | |
| 5,129,828 | A | | 7/1992 | Bass | |
| 5,133,674 | A | * | 7/1992 | Albrecht | 439/465 |
| D332,942 | S | | 2/1993 | Julien | |
| 5,380,209 | A | | 1/1995 | Converse, Jr. | |
| 5,722,854 | A | | 3/1998 | Geisler | |
| 5,725,228 | A | | 3/1998 | Livingston | |
| 5,774,980 | A | * | 7/1998 | Klein et al. | 29/857 |
| 5,800,188 | A | * | 9/1998 | Barber et al. | 439/142 |
| 5,816,824 | A | | 10/1998 | White | |
| 5,904,261 | A | | 5/1999 | Belinky | |
| D415,117 | S | | 10/1999 | Belinky | |
| 6,010,354 | A | * | 1/2000 | Cunningham | 439/417 |
| 6,019,386 | A | | 2/2000 | Morelock | |
| 6,076,691 | A | | 6/2000 | Belinky | |
| 6,089,907 | A | | 7/2000 | Shoblom | |
| 6,203,333 | B1 | * | 3/2001 | Medina et al. | 439/76.1 |
| 6,247,978 | B1 | * | 6/2001 | Wu | 439/879 |
| 6,616,477 | B1 | * | 9/2003 | Chang | 439/465 |
| 6,685,502 | B2 | | 2/2004 | Wheeler | |
| 6,688,905 | B2 | * | 2/2004 | Williams | 439/461 |
| 6,695,639 | B2 | * | 2/2004 | Castaldo et al. | 439/467 |

* cited by examiner

*Primary Examiner*—Gary Paumen
(74) *Attorney, Agent, or Firm*—Dennis W. Beech

(57) ABSTRACT

The trailer electrical connector enclosure may be used for retaining and protecting an electrical connector on towing vehicles. An enclosure may have a first enclosure element and a second enclosure element attached by a fastener. The first enclosure element and the second enclosure element may have a main wall, two side wall elements and a back wall element. The main wall element may have a connector portion, an outwardly expanding portion and a rectangular portion having an open end. A cover may be pivotally attached to a side wall of the enclosure biased by a spring for closure of the open end portions. A clamp pedestal may be attached to an interior surface of the main wall and a back wall may have an aperture.

9 Claims, 2 Drawing Sheets

TRAILER ELECTRICAL CONNECTOR ENCLOSURE

BACKGROUND OF THE INVENTION

This invention relates to devices for retaining and protecting electrical connectors on towing vehicles, such as automobiles or trucks, that may be used for connection of the electrical system of a towed trailer. The new box like enclosure housing may be constructed of two mirror image elements that may be fastened together to retain an electrical connector with the plug or electrical contacts accessible through an open end that may be closed by a spring actuated cover closure.

Various holders or housings may be known for enclosure of electrical connectors on towing vehicles. In some vehicles the original equipment manufacturer may provide an electrical connector integral with a bumper or other vehicle structure. There may also be various after market enclosures or retainers for the wiring and connectors associated with towing vehicles. These enclosures may allow storage of a length of wiring and the associated connector for removal and connection to a plug of a trailer electrical system. Other enclosures or housings may have a support structure or seat to retain the electrical connector in a portion of the structure for plugging the trailer connector therein. Such housings may have additional structural elements such as baffle type friction elements for securing lead wires associated with an electrical connector.

SUMMARY OF THE INVENTION

The present invention is directed to devices for retaining and protecting an electrical connector on towing vehicles. An enclosure may have a first enclosure element and a second enclosure element attached by a fastener. The first enclosure element and the second enclosure element may have a main wall, two side wall elements and a back wall element. The main wall element may have a connector portion, an outwardly expanding portion and a rectangular portion having an open end. A cover may be pivotally attached to a side wall of the enclosure biased by a spring for closure of the open end portions. A clamp pedestal may be attached to an interior surface of the main wall and a back wall may have an aperture.

These and other features, aspects and advantages of the present invention will become better understood with reference to the following drawings, description and claims.

DETAILED DESCRIPTION

Figure 1:
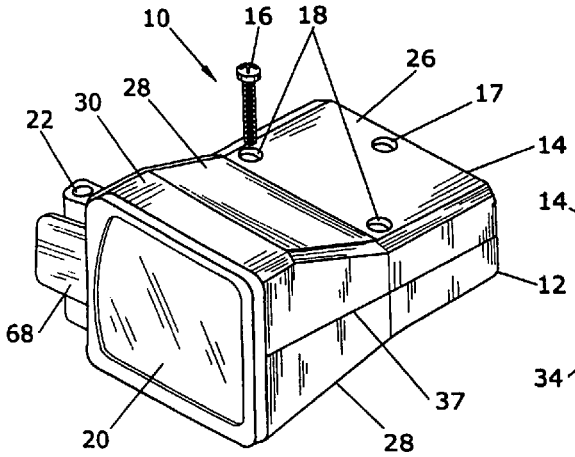
FIG. 1 illustrates a perspective frontal view of the trailer electrical connector enclosure according to an embodiment of the invention.
Figure 2:
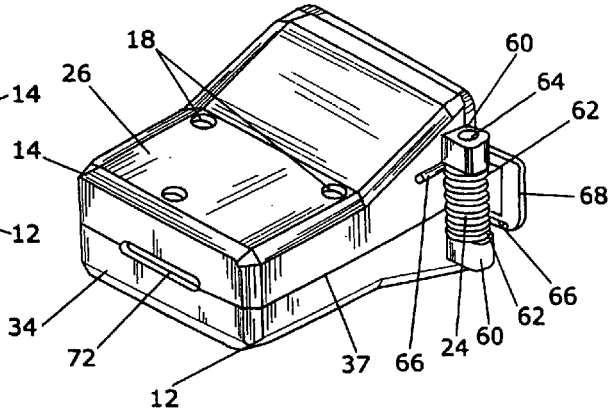
FIG. 2 illustrates a perspective rear view of the enclosure according to an embodiment of the invention.
Figure 3:
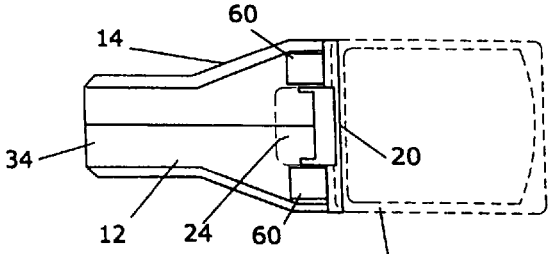
FIG. 3 illustrates a side elevation view of the enclosure according to an embodiment of the invention.
Figure 4:
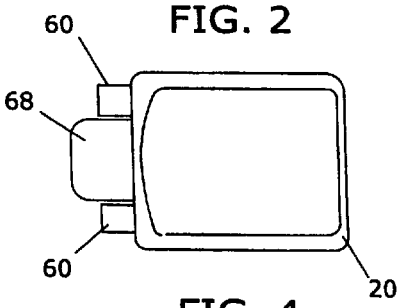
FIG. 4 illustrates a front elevation view of the enclosure according to an embodiment of the invention.
Figure 5:
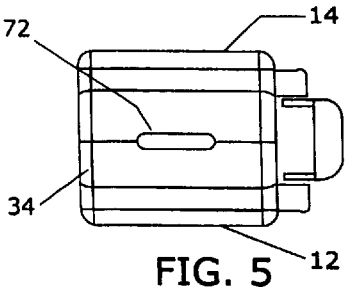
FIG. 5 illustrates a rear elevation view of the enclosure according to an embodiment of the invention.
Figure 6:
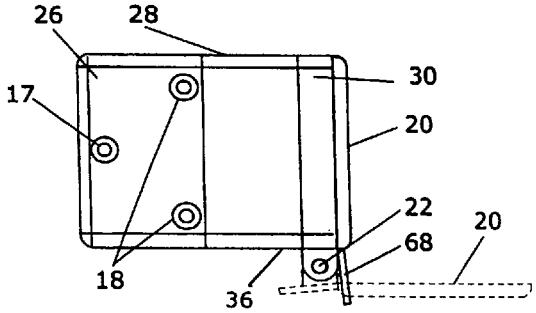
FIG. 6 illustrates a top plan elevation view of the enclosure according to an embodiment of the invention.
Figure 7:
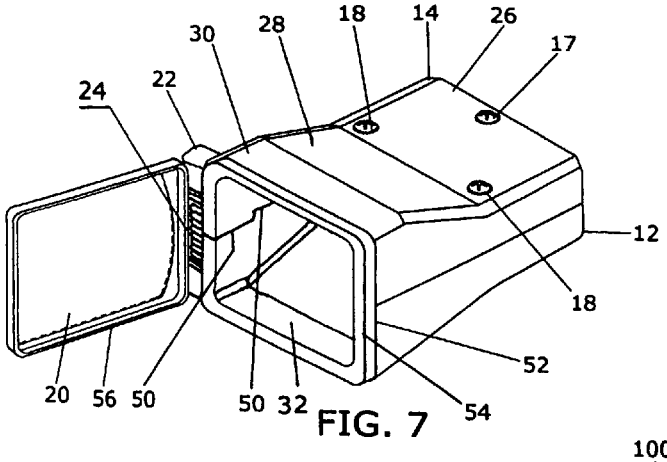
FIG. 7 illustrates a perspective frontal view of the enclosure with the cover opened according to an embodiment of the invention.
Figure 8:
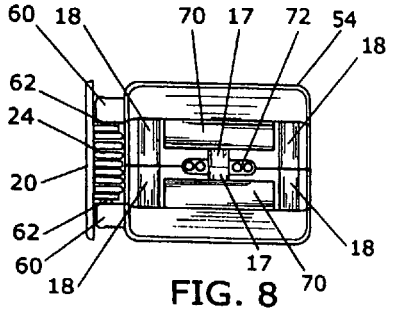
FIG. 8 illustrates a front view of the enclosure with the cover opened according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 9, a trailer electrical connector enclosure 10 may be generally a box like enclosure housing formed from a first enclosure element 12 and a second enclosure element 14 that may be attached one to the other with screws 16 in tubular apertures 17 and 18. The enclosure elements 12, 14 may be mirror image structures that may be assembled together along edges 37 and retained by screws 16, by nuts and bolts or by other suitable fasteners. There may be a closure or cover 20 that may be hinged to a side wall 36 by hinge 22 that may have a torsion spring 24 biased to close the cover 20 on open end 32 of the enclosure 10.

The enclosure 10 may have a generally rectangular cross section connector portion 26 attached to an outwardly expanding, relative to interior 27, portion 28 that may terminate in a generally rectangular portion 30 forming an open end 32. There may be a back wall 34 for closure of connector portion 26. The flared or outwardly expanding portion 28 may allow a user to grip trailer plug (not shown) for insertion or removal with an electrical connector 100 retained in the enclosure 10.

Figure 9:
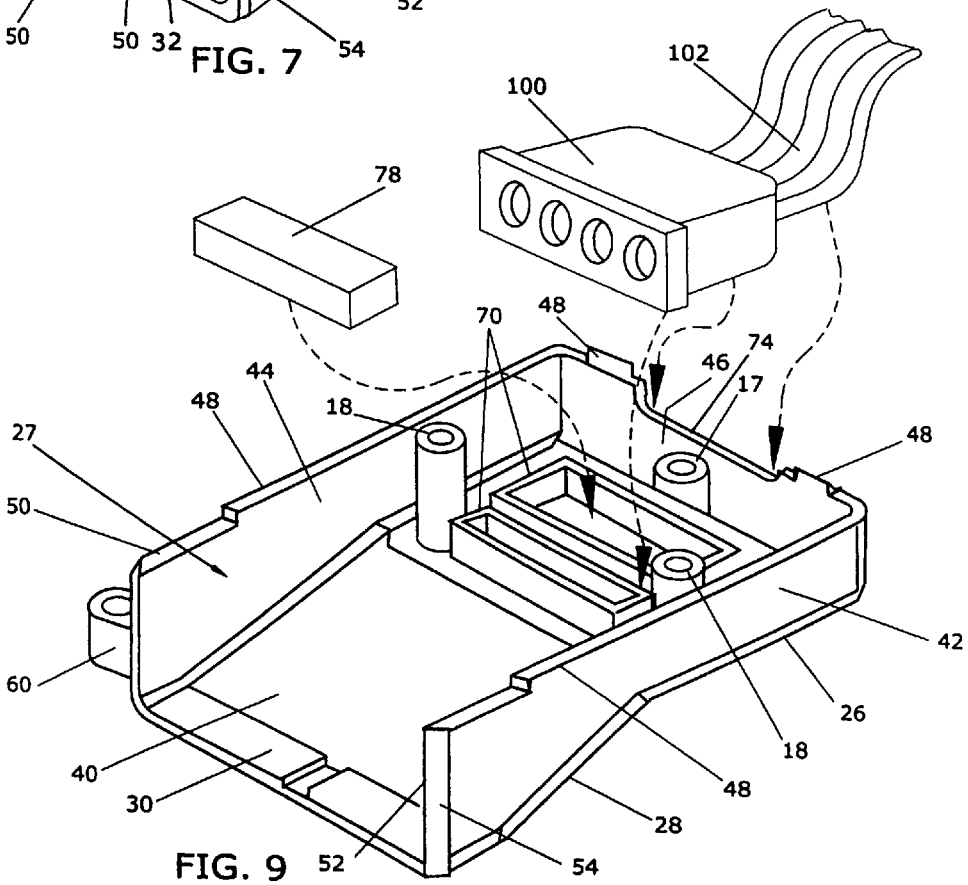
FIG. 9 illustrates a perspective view of one of the two enclosure elements according to an embodiment of the invention.

The enclosure elements 12, 14 may be structured, as described with reference to a first enclosure element 12 as best viewed in FIG. 9, having a main wall 40, side wall elements 42, 44 and a back wall element 46. The main wall 40 may have an outwardly expanding portion 28 as previously described. There may be a hinge post 60 protruding from one of side wall elements 42, 44 to allow hinged attachment of the cover 20. There may be a flange 48 on an edge of one of side wall elements 42, 44 and an indentation 50 in the opposite or second one of side wall elements 42, 44. There also may be a flange 48 and indentation in back wall element 46. The flanges and indentations may aid in guiding and fastening enclosure elements 12, 14 one to the other with a flange of one element mating with an indentation of the second element.

There may also be a flange 54 on the edge 52 of open end portion 32 that may engage a flange 56 of the cover 20 to aid in closure of cover 20. The cover 20 may be attached to a side wall 36 by a pair of hinge posts 60, a pair of cover posts 62 and a hinge pin 64 disposed in said posts 60, 62. There may be a torsional spring 24 axially disposed on the hinge pin 64. The spring 24 may have spring extension 66 positioned to bias the spring 24 to close cover 20. There may be a cover tab 68 for movement or restricting movement of cover 20.

A rectangular support structure or clamp pedestal 70 may be attached to the interior of the main wall 40 in the connector portion 26. The clamp pedestal 70 may serve as a friction retainer for an electrical connector 100 when enclosure elements 12, 14 are attached together for clamp pedestals 70 to engage the electrical connector 100 there between. There may be two or more clamp pedestals 70.

Block inserts 78 may be inserted in the clamp pedestal 70 to accommodate different thickness dimensions of electrical connectors 100.

There may be an aperture 72 in the back wall 34 that may be a friction aperture to aid in retaining electrical connector 100 lead wires 102 in the enclosure 10. The aperture 72 may be formed by an aperture indentation 74 in back wall element 46 of the enclosure elements 12, 14.

The enclosure 10 may be attached to a bumper of a vehicle, to a trailer hitch attached to a vehicle or to other structure associated with the towing vehicle. The cover 20 may be held open by a trailer plug (not shown) connected to the electrical connector 100 during use for towing.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for retaining and protecting an electrical connector on towing vehicles comprising:

an enclosure having a first enclosure element and a second enclosure element attached by a fastener;

said first enclosure element and said second enclosure element comprising a main wall, two side wall elements and a back wall element;

said main wall element having a connector portion, an outwardly expanding portion and a rectangular portion having an open end;

a cover pivotally attached to a side wall of said enclosure biased by a spring for closure of said open end portions; and a clamp pedestal attached to an interior surface of said main wall and a back wall having an aperture therein.

2. The device as in claim 1 wherein said aperture is sized to frictionally engage a lead wire of an electrical connector disposed in said enclosure.

3. The device as in claim 1 wherein said outwardly expanding portion is structured to allow gripping of a trailer plug when inserted in said electrical connector.

4. The device as in claim 1 wherein said attachment is a plurality of fasteners engaged in a plurality of tubular apertures of said first enclosure element and said second enclosure element.

5. The device as in claim 1 wherein one of said side wall elements having an indentation positioned for engagement with a flange on a second one of said side wall elements when said first enclosure element and said second enclosure element are joined for attachment.

6. The device as in claim 1 wherein said pivotal attachment is a hinge and said cover having a cover tab to limit rotational motion of said cover relative to said open end.

7. The device as in claim 6 wherein said spring is a torsional spring axially disposed on a hinge pin disposed in a pair of hinge posts attached to said side wall and in a pair of cover posts attached to said cover.

8. The device as in claim 1 wherein a block insert is disposed in said clamp pedestal.

9. A device for retaining and protecting an electrical connector on towing vehicles comprising:

an enclosure having a first enclosure element and a second enclosure element attached by a fastener;

said first enclosure element and said second enclosure element comprising a main wall, two side wall elements and a back wall element;

said main wall element having a connector portion, an outwardly expanding portion wherein said outwardly expanding portion is structured to allow gripping of a trailer plug when inserted in said electrical connector and a rectangular portion having an open end;

a cover pivotally attached to a side wall of said enclosure biased by a spring for closure of said open end portions; and a clamp pedestal attached to an interior surface of said main wall and a back wall having an aperture therein wherein said aperture is sized to frictionally engage a lead wire of an electrical connector disposed in said enclosure.

* * * * *